US005189341A

United States Patent [19]

Itoh et al.

[11] Patent Number: 5,189,341

[45] Date of Patent: Feb. 23, 1993

[54] ELECTRON EMITTING ELEMENT

[75] Inventors: Shigeo Itoh; Teruo Watanabe; Hisashi Nakata; Toshinori Takagi, all of Mobara, Japan

[73] Assignee: Futaba Denshi Kogyo Kabushiki Kaisha, Mobara, Japan

[21] Appl. No.: 701,027

[22] Filed: May 16, 1991

[30] Foreign Application Priority Data

May 17, 1990 [JP] Japan ..... 2-125435

[51] Int. Cl.[5] ..... H01J 1/02

[52] U.S. Cl. ..... 315/169.1; 315/334; 315/337; 313/309; 313/336; 313/351

[58] Field of Search ..... 445/2, 5, 6, 59; 313/309, 336, 351; 315/169.1, 334, 337

[56] References Cited

U.S. PATENT DOCUMENTS 3,308,330 3/1967 Charles ..... 313/351
3,755,704 8/1973 Spindt et al. ..... 313/309
4,904,895 2/1990 Tsukamoto et al. ..... 313/351
4,908,539 3/1990 Meyer ..... 315/169.1

FOREIGN PATENT DOCUMENTS 0121454 10/1978 Japan ..... 313/309
61-221783 2/1986 Japan .
0033833 2/1989 Japan ..... 313/336

*Primary Examiner*—Donald J. Yusko
*Assistant Examiner*—N. D. Patel
*Attorney, Agent, or Firm*—Oblon, Spivak, McClelland, Maier & Neustadt

[57] ABSTRACT

An electron emitting element capable of preventing pollution of the emitter due to absorption of gas thereon, to thereby ensure stable emission of electrons over a long period of time even in a low vacuum atmosphere. The electron emitting element is constructed so as to permit a part of electrons emitted from one of emitters to impinge on the other of the emitters being ready for emission to clean it.

9 Claims, 8 Drawing Sheets

ELECTRON EMITTING ELEMENT

BACKGROUND OF THE INVENTION

This invention relates to an electron emitting element of the field emission type, and more particularly to an electron emitting element suitable for use as an electron source for various kinds of display devices, a light source, an amplifier element, a high-speed switching element, a sensor or the like.

A vertical-type electron emitting element which is typical one of an electron emitting element of the field emission type is generally constructed in such a manner as shown in FIG. 11. More specifically, it includes a substrate 100 doped with impurities in high concentration, resulting in being provided with high conductivity. On the substrate 100 is arranged an insulating layer 101 made of $SiO_2$, which is formed therein with cavities 102. In each of the cavities 102 is arranged an emitter 103 made of molybdenum (Mo) so as to serve as an electron emitting section. Also, the electron emitting element includes a Mo thin film deposited on the insulating layer 101 in a manner to surround the emitter 103 so as to function as a gate electrode 104.

In the electron emitting element constructed as described above, when the gate electrode 104 is biased within the range of tens to hundreds V against the substrate 100, an electrical field as high as $10^6$ to $10^7$ V/cm is caused to be produced between the distal end of the emitter 103 and the gate electrode 104, so that electrons of hundreds mA in all may be emitted from the distal end of the emitter 103.

FIG. 12 shows a conventional display device in which the so-constructed electron emitting element is used as an electron source. The conventional display device is disclosed in, for example, Japanese Patent Application Laid-Open Publication No. 221783/1986.

The conventional display device is constructed in such a manner that a plurality of conductive films 112 are arranged on an insulating substrate 110 so as to extend in the direction of columns 111. On the conductive film 112 are provided cone-like emitters 113 of the field emission type and an insulating layer 114. On the insulating layers 114 are arranged a plurality of grids 116 in a manner to extend in the direction of rows 115. The grids 116 each are formed at the portion thereof opposite to each of the cone-like emitters 113 with an aperture or hole.

The display device also includes a transparent substrate 117. On the surface of the transparent substrate 117 opposite to the insulating substrate 110 are deposited a transparent conductive film 118 and a phosphor layer 119 in a manner to be laminated in order. The conductive film 118 and phosphor layer are arranged all over the substrate 117. The insulating substrate 110 and transparent substrate 117 cooperate with side plates (not shown) to form an envelope, which is then evacuated to a high vacuum.

Now, the manner of operation of the conventional display device constructed as described above will be described hereinafter.

A positive potential is constantly applied to the transparent conductive film 118. In response to a display signal, a predetermined potential difference is applied between the conductive film 112 of each of the rows 115 and the grid 116 of each of the columns. This causes a suitable electric field to be formed between the grid 116 to which the potential difference is applied and the cone like emitter 113, resulting in electrons being emitted from the pointed distal end of the emitter 116. The so-emitted electrons travel through the hole of the grid 116 and then impinge on the phosphor layer 119, leading to light-emission or luminance of the phosphor layer 119.

Thus, an image is displayed depending upon the display signal.

FIG. 13 shows a horizontal-type electron emitting element which is another one of an electron emitting element of the field emission type, which is disclosed in, for example, in Japanese Patent Application Laid-Open Publication No. 33833/1989.

The horizontal-type electron emitting element includes an insulating substrate 200, on which an emitter 202 provided at the central portion thereof with a triangle projection 201 is arranged. Also, the substrate 200 is provided thereon with a gate 204 in a manner to be adjacent to the emitter 202. The gate 204 is formed with an aperture or hole 203 at the portion thereof corresponding to the projection 201. Also, the electron emitting element includes a secondary electron-emitting electrode 205 in a manner to interpose the gate 204 between the emitter 202 and the electrode 205 and be in parallel to the gate 204.

In the horizontal-type electron emitting element constructed as described above, when predetermined potential differences are applied between the emitter 202 and the gate 204 and between the gate 204 and the secondary electron emitting electrode 205, respectively, electrons emitted from the pointed distal end of the emitter 202 impinge through the aperture 203 of the gate 204 onto the secondary electron-emitting electrode 205, so that secondary electrons are emitted from the secondary electrode 205.

Unfortunately, when the conventional electron emitting element of each type described above is driven in an airtightly or hermetically sealed envelope or at a vacuum atmosphere as low as $10^{-6}$ to $10^{-7}$ Torr, it causes some disadvantages. More specifically, mounting of the electron emitting element in an airtight envelope causes the emitter to be polluted during the mounting operation, so that the emitter may be significantly increased in emission threshold. Also, driving of the electron emitting element in a low vacuum atmosphere causes the emitter to absorb any gas in the atmosphere, resulting in the electron emitting element being increased in work function in a short period of time. This leads to disadvantages of causing an emission efficiency of the element to be reduced and/or its emission threshold to be increased. The disadvantages are remarkably exhibited particularly when the electron emitting element of the field emission type is used while being mounted in the airtight envelope. Use of a filed emission (FE) cathode in the form of being mounted in a hermetic envelope is never realized unless the disadvantages are solved.

SUMMARY OF THE INVENTION

The present invention has been made in view of the foregoing disadvantages of the prior art.

Accordingly, it is an object of the present invention to provide an electron emitting element which is capable of stably and positively emitting electrons over a long period of time even in a low vacuum atmosphere.

It is another object of the present invention to provide an electron emitting element which is capable of effectively preventing pollution of an emitter due to absorption of gas thereon.

In accordance with the present invention, an electron emitting element is provided. The electron emitting element includes a plurality of emitters and a gate. To at least one of the emitters is alternately applied a field electron emission voltage equal to or above a voltage of the gate.

Also, in accordance with the present invention, an electron emitting element is provided. The electron emitting element includes a pair of electrodes having an electric field capable of permitting emission of field electrons alternately formed between the electrodes so that one of the electrodes has a field electron emission voltage applied thereto and functions as an emitter and the other of the electrodes has a voltage higher than the field electron emission voltage applied thereto and functions as a gate.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, an electron emitting element according to the present invention will be described hereinafter with reference to FIGS. 1 to 10.

Figure 1:
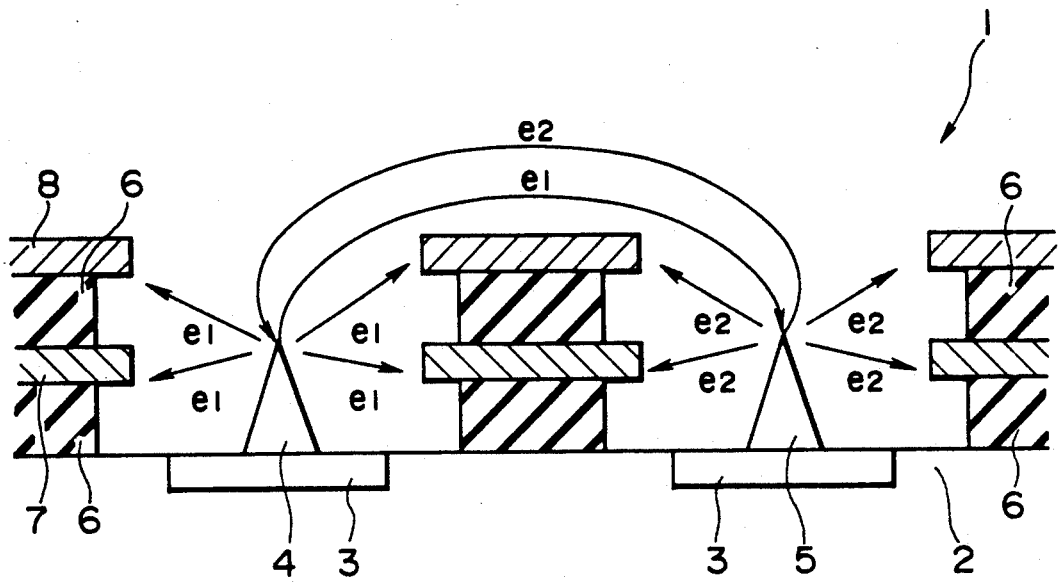
FIG. 1 is a schematic sectional view showing a first embodiment of an electron emitting element according to the present invention;.

FIG. 1 shows a first embodiment of an electron emitting element according to the present invention, wherein an electron emitting element of the illustrated embodiment is generally indicated at reference numeral 1. The electron emitting element 1 includes a substrate 2, on which a plurality of emitter electrodes 3 are arranged in a manner to be separated or divided from each other to form each pair. The electron emitting element 1 also includes emitters 4 and 5 respectively provided on the emitter electrodes 3, insulating layers 6, a gate 7 and a collector 8.

The electron emitting element 1 of the illustrated embodiment constructed as described above is so driven that when one emitter (or emitter group) 4 provided on one of the emitter electrodes 3 divided from each other emit electrons $e_1$ under normal electric field conditions, a positive potential of a predetermined level equal to or above that of the gate 7 is applied to the other emitter (emitter group) 5; whereas when the other emitter 5 emit electrons $e_2$, a positive potential of the above-described level is applied to the one emitters 4.

The driving of the electron emitting element 1 in the manner described above permits the electrons $e_1$ emitted from the one emitter 4 to impinge on the other emitter 5 to clean the emitter 5 and the electrons $e_2$ emitted from the other emitter 5 to likewise clean the emitter 4.

When a half-wave sine wave which is negative with respect to the gate 7 is applied to the one emitter 4, a D.C. or positive half-wave sine wave which has a level equal to or above a voltage applied to the gate 7 is applied to the other emitter 5 for the purpose of carrying out electron beam impact heating to a degree sufficient to remove gas physically absorbed on the other emitter 5.

In the illustrated embodiment, the number of emitters 4 or 5 provided on each of the emitter electrodes 3 may be at least one. When a plurality of drive systems are arranged so as to be separated or divided from each other, the number of emitters (emitter groups) 4 or 5 may be at least two. When the electron emitting element of the illustrated embodiment is used for a display device, a tetrode structure may be employed which is so constructed that a phosphor-deposited anode is arranged in addition to the collector 8 and a positive potential equal to or above a voltage applied to the collector 8 is applied to the anode. Alternatively, a triode structure wherein the collector 8 may function also as an anode may be employed.

Figure 2:
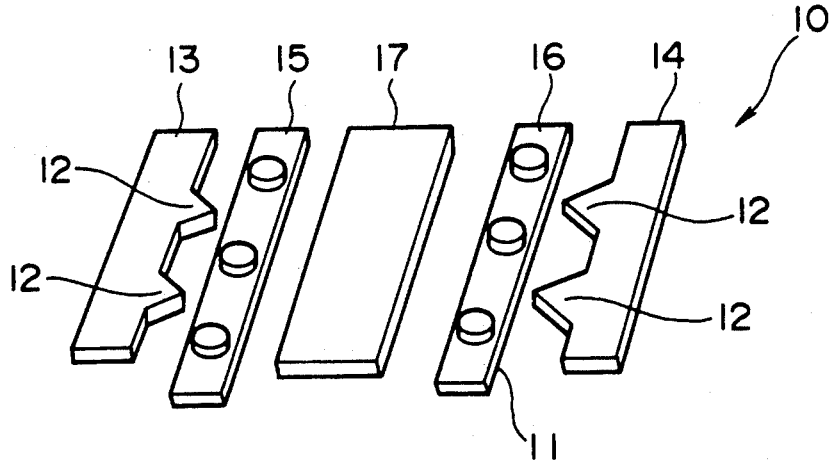
FIG. 2 is a perspective view showing a second embodiment of an electron emitting element according to the present invention.

FIG. 2 shows a second embodiment of an electron emitting element according to the present invention, which is constructed into a horizontal-type structure.

More particularly, an electron emitting element of the second embodiment generally designated at reference numeral 10 includes a substrate 11, on which emitters 13 and 14 each provided with a triangular projections 12 are arranged opposite to each other with a collector 17 being interposed therebetween and gates 15 and 16 are respectively arranged between the emitter 13 and the collector 17 and between the emitter 14 and the collector 17. As in the first embodiment described above, the electron emitting element of the second embodiment is so driven that one emitter 13 or 14 is caused to emit electrons while applying a positive potential of a predetermined level equal to or above that applied to the gates 15 and 16, resulting in a part of the electrons emitted from the emitter 13 or 14 impinging on the other emitter 14 or 13 to clean it. This permits alternate emitting of electrons from the emitters 13 and 14 to be stably carried out.

Figure 3:
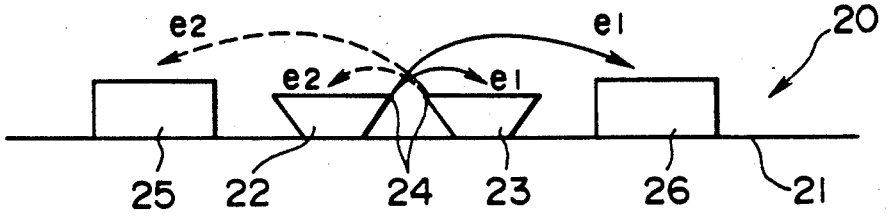
FIG. 3 is a side elevation view showing a third embodiment of an electron emitting element according to the present invention.
Figure 4:
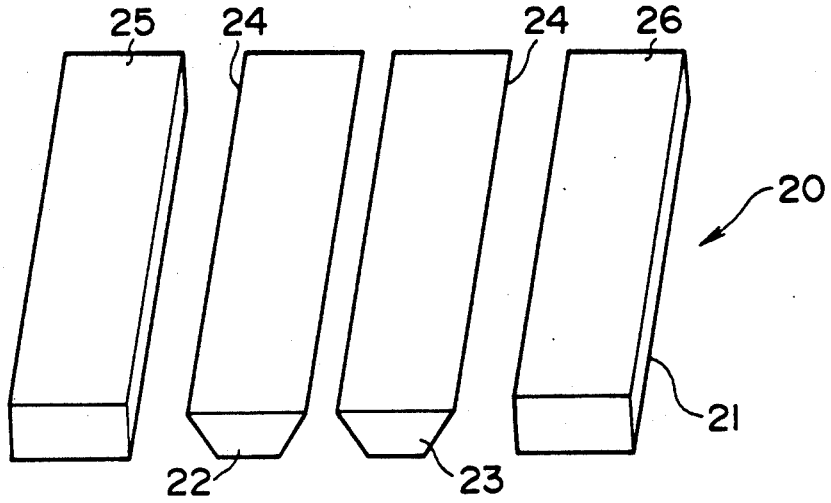
FIG. 4 is a perspective view of the electron emitting element shown in FIG. 3.

FIGS. 3 and 4 show a third embodiment of an electron emitting element according to the present invention, which is constructed into a horizontal-type structure.

An electron emitting element of the illustrated embodiment which is generally designated at reference numeral 20 includes a substrate 21, on which two electrodes 22 and 23 each formed into an inverted trapezoid shape are arranged in parallel so as to serve as an emitter and a gate. Thus, the electrodes 22 and 23 are so placed that sharp side edges 24 thereof are positioned up. Also, the electron emitting element 20 includes two collectors 25 and 26 arranged on the substrate 21 in a manner to be positioned outside the electrodes 22 and 23 and parallel to the electrodes 22 and 23, respectively.

The electron emitting element of the third embodiment constructed as described above is driven in such a manner that a half-wave sine wave and a gate voltage are alternately applied to the electrodes 22 and 23 or positive and negative sine waves are alternately applied to the electrodes 22 and 23. Such driving permits electrons $e_1$ emitted from the sharp side edge 24 of one of the electrodes acting as the emitter or the electrode 22 to reach one of the collectors 25 and 26 or the collector 26 and impinge on the other electrode 23, to thereby clean the electrode 23. The converse permits the electrode 22 to be cleaned.

Figure 5:
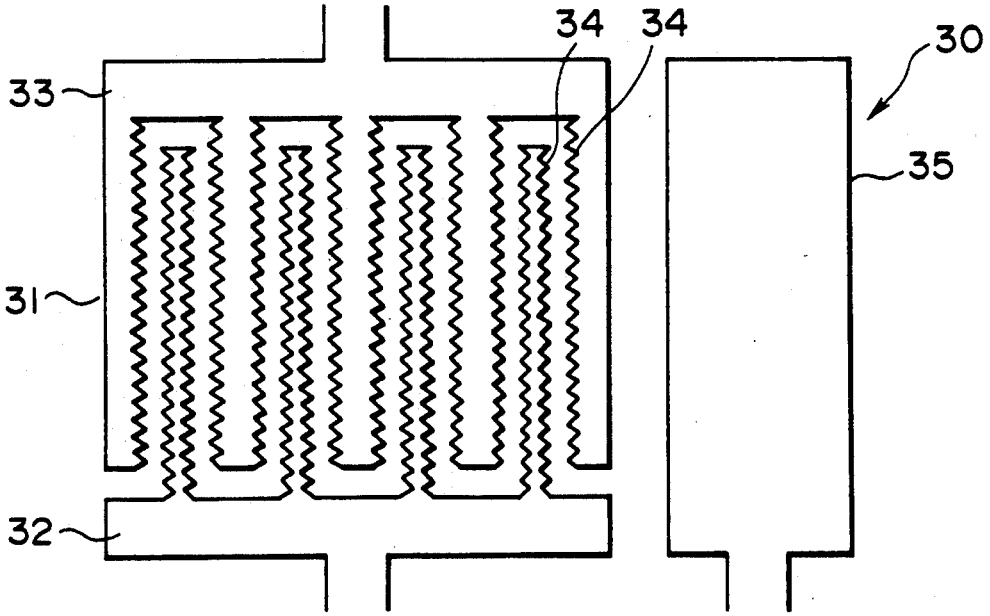
FIG. 5 is a plan view showing a fourth embodiment of an electron emitting element according to the present invention.

FIG. 5 shows a fourth embodiment of an electron emitting element according to the present invention, which is constructed into a horizontal-type structure.

An electron emitting element of the fourth embodiment which is generally designated at reference numeral 30 includes a substrate 31, on which a plurality of two-in-a-set electrodes 32 and 33 functioning as emitters and gates are arranged in a telescopic manner. The electrodes 32 and 33 each are formed with a number of pointed projections 34, resulting in being formed into a saw-like shape. Also, the pointed projections 34 of the electrodes 32 and 33 are arranged opposite to each other. Further, the element of the illustrated embodiment includes a collector 35.

To the electrodes 32 and 33 are alternately applied a half-wave sine wave and a gate voltage or positive and negative sine waves as in the third embodiment described above with reference to FIGS. 3 and 4. This permits the embodiments to exhibit the same function and advantage as the third embodiment.

Figure 6:
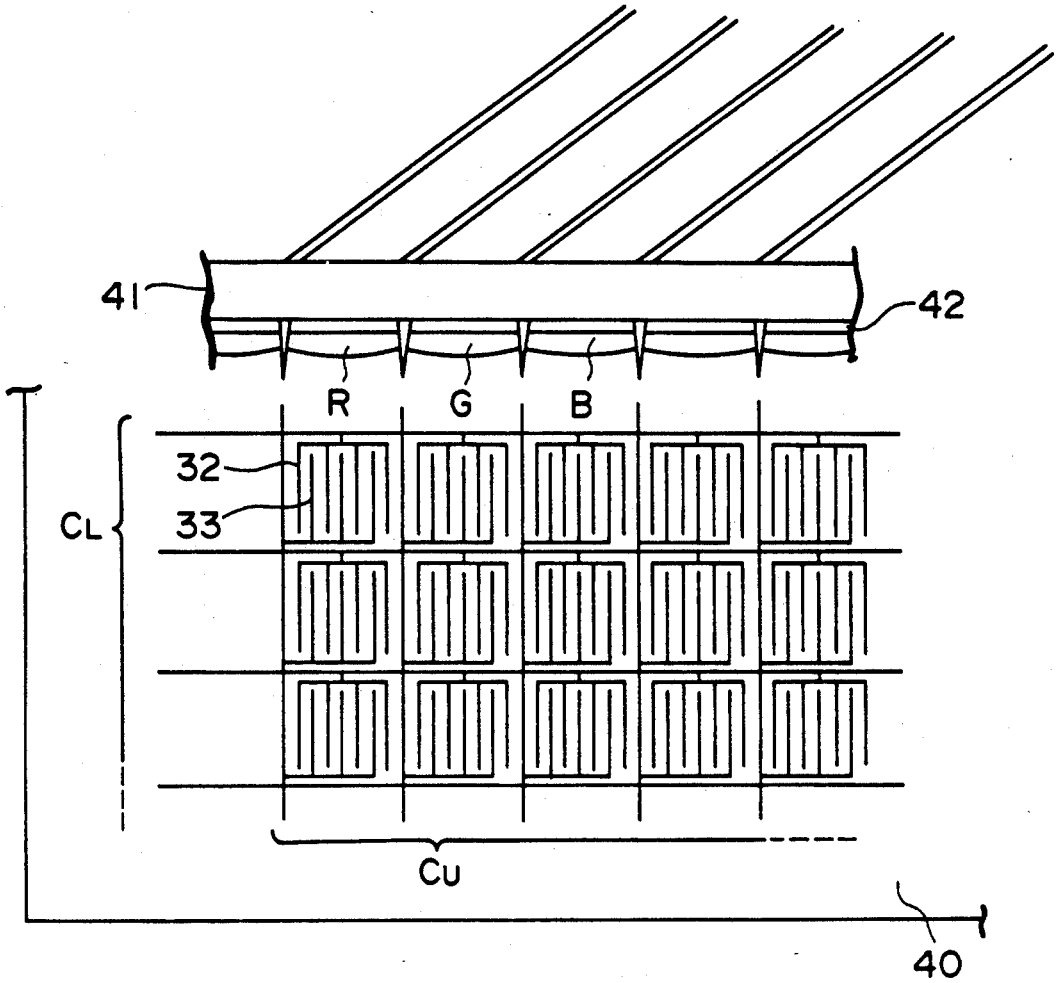
FIG. 6 is a schematic view showing a display device in which the electron emitting element of FIG. 5 is incorporated.

FIG. 6 exemplifies a display device utilizing the principle of a fluorescent display device in which the electron emitting element shown in FIG. 4 is incorporated.

In the display device shown in FIG. 6, a combination of the electrodes 32 and 33 arranged in a telescopic manner is provided on a first substrate 40. One electrodes $C_L$ which are connected together and then commonly drawn out are supplied with a drive signal and the other electrodes $C_U$ which are connected together and then commonly drawn out are supplied with a drive signal in synchronism with the supply of the drive signal to the one electrodes $C_L$, so that any desired emitter within the matrix may be selected. To the emitter being selected is applied a signal shown in FIG. 7.

Figure 7:
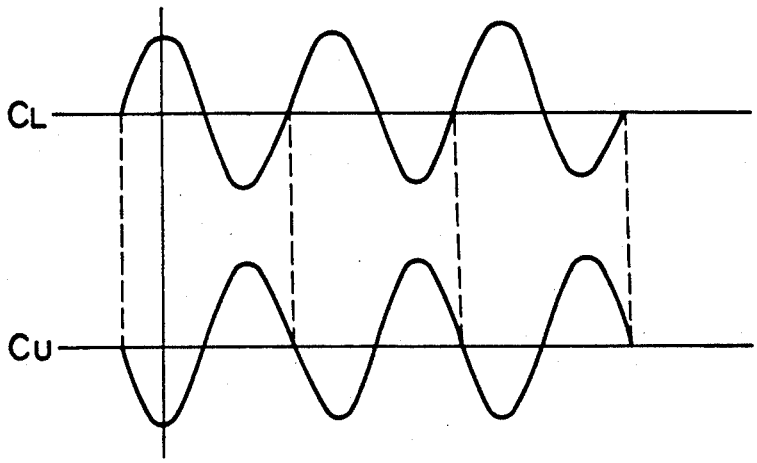
FIG. 7 is a wave form chart showing a signal applied to an emitter being selected in the electron emitting element shown in FIG. 6.

Also, in the example shown in FIG. 7, the collector 35 is replaced with a transparent electrode 42 provided on a second substrate 41 arranged opposite to the first substrate 40 so as to function as an anode. The transparent electrode 42 is formed into a strip-like shape, on which phosphors R, G and B of red, green and blue luminous colors are repeatedly deposited in order.

Figure 8:
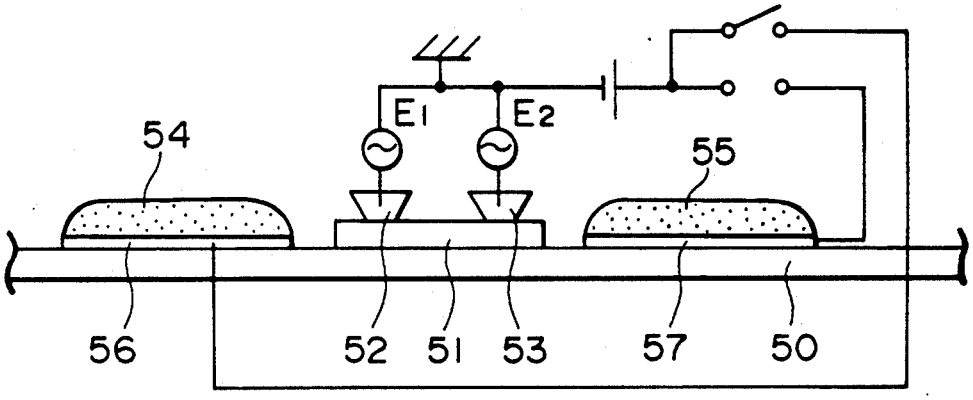
FIG. 8 is a sectional view showing a display device in which the electron emitting element shown in FIG. 3 is incorporated.

In the display device of FIG. 6 constructed as described above, the application of a signal as shown in FIG. 8 to each of the electrodes $C_L$ and $C_U$ to cause electrons to be emitted from the electrodes 32 and 33 at desired positions permits the phosphors R, G and B to be selected in a dot-like manner, resulting in the selected phosphors emitting light to display a character or figure desired.

FIG. 8 exemplifies a display device utilizing the principle of a fluorescent display device in which an electron emitting element constructed according to FIGS. 3 and 4 is incorporated.

Figure 10:
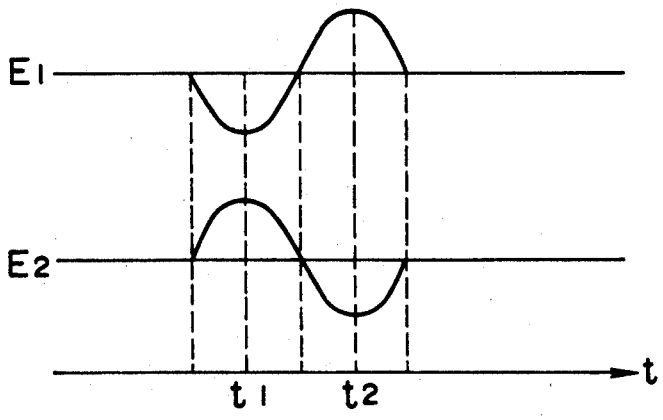
FIG. 10 is a wave form chart showing a signal supplied to an electrode in the display device shown in FIG. 8.
Figure 11:
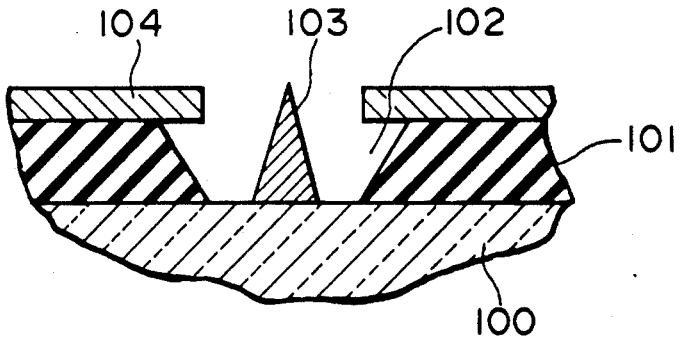
FIG.11 PRIOR ART
FIG. 11 is a sectional view showing a conventional vertical-type electron emitting element of the field emission type.
Figure 12:
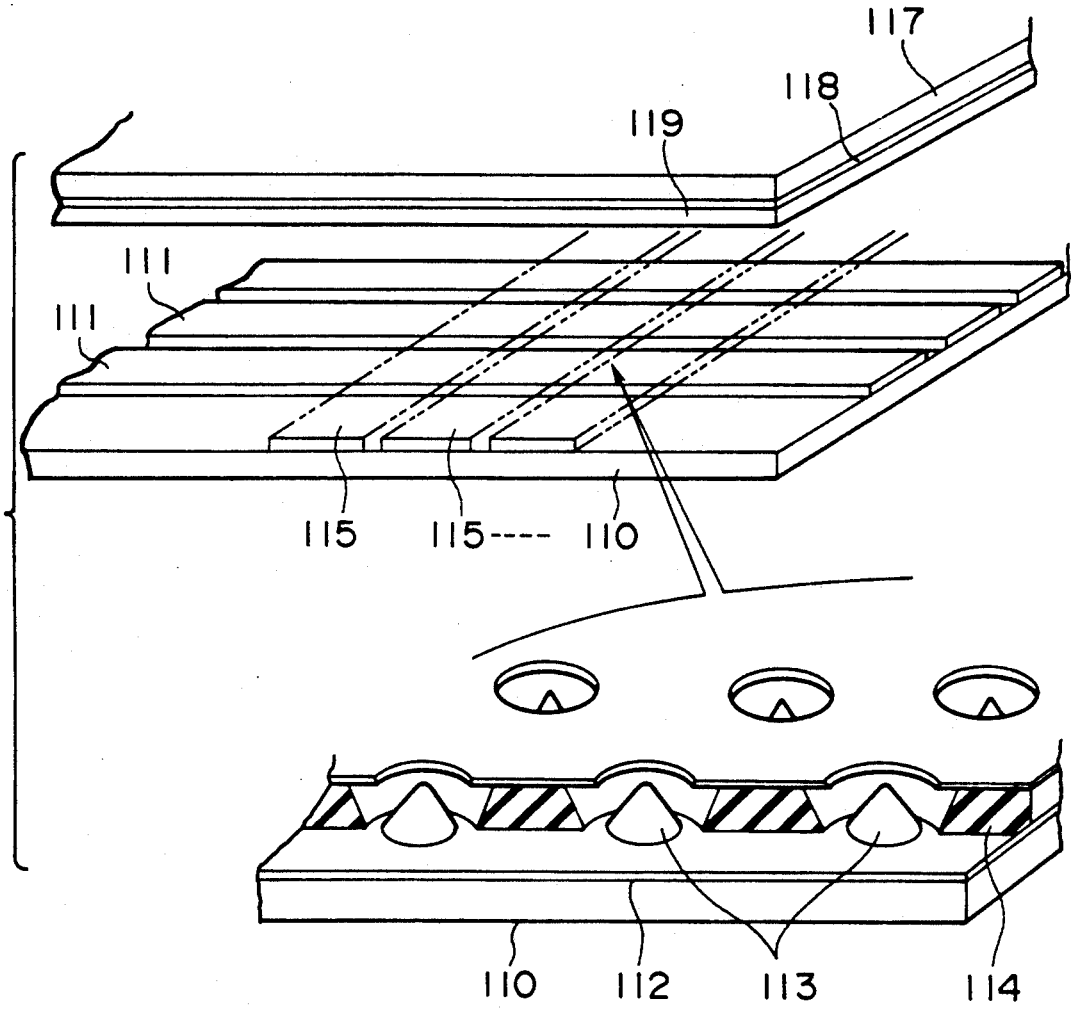
FIG.12 PRIOR ART
FIG. 12 is a schematic perspective view showing a display device in which the electron emitting element shown in FIG. 11 is used.
Figure 13:
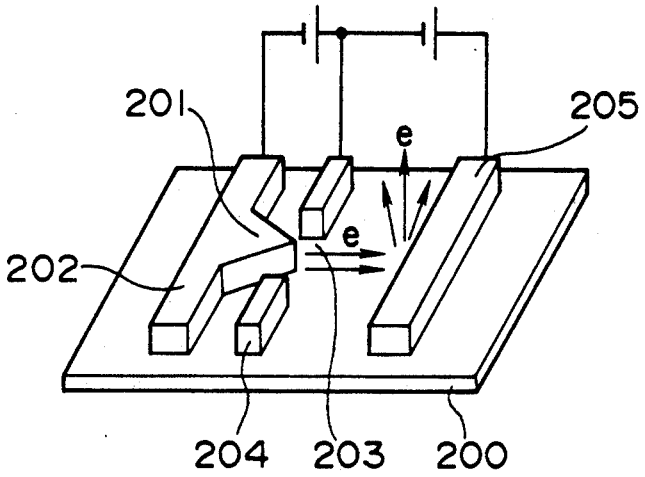
FIG.13 PRIOR ART
FIG. 13 is a perspective view showing a conventional horizontal-type electron emitting element of the field emission type.

In the display device shown in FIG. 8, a pair of electrodes 52 and 53 of an inverted trapezoid shape are arranged on an insulating substrate 50 through an insulating layer 51 in a manner to be parallel to each other. Also, the display device includes anodes 56 and 57 which are deposited thereon with phosphor layers 54 and 55 and arranged outside the electrodes 52 and 53, respectively. To the electrodes 52 and 53 are connected power supplies $E_1$ and $E_2$ so that sine waves of which phases are deviated in 180° from each other as shown in FIG. 10 or rectangular waves (not shown) are applied to the electrodes 52 and 53, respectively. Also, to each of the anodes 56 and 57 is applied a voltage which is positive with respect to the electrodes 52 and 53.

Figure 9A:
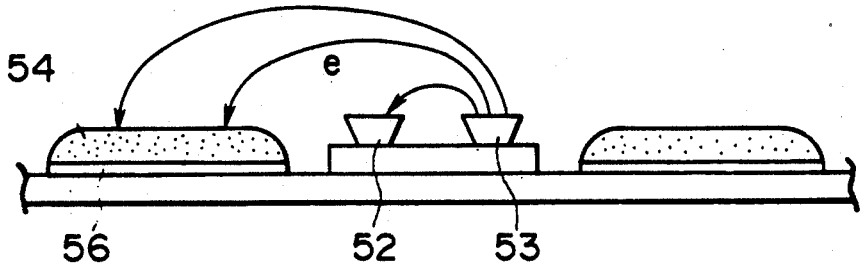
FIGS. 9A and 9B each are a sectional view showing the operation of the display device of FIG. 8.
Figure 9B:
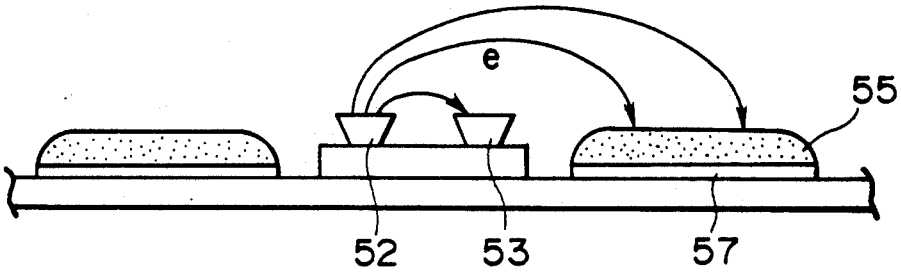

The display device of FIG. 8 constructed as described above is so driven that sine waves as shown in FIG. 10 are applied to the electrodes 52 and 53 and a positive potential is applied to one of the anodes 56 and 57. At time $t_1$ (FIG. 10), the right electrode 53 acts as an emitter as shown in FIG. 9A, so that electrons emitted therefrom impinge on the phosphor layer 54 of the left anode 56. Concurrently, a part of the electrons impinges on the left electrode 52 acting as a gate to clean it. At time $t_2$, the left electrode 52 functions as an emitter as shown in FIG. 9B, so that the right anode 57 emits light, so that the right electrode 53 is cleaned.

As can be seen from the foregoing, the electron emitting element of the present invention permits a part of electrons emitted from the emitter to impinge on the other emitter being ready for emission to clean it. Thus, the present invention effectively prevent pollution of the emitter due to absorption of gas thereon, to thereby ensure stable emission of electrons over a long period of time even in a low vacuum atmosphere.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed as new and desired to be secured by Letters Patent of the United States is:

1. An electron emitting element comprising:

an evacuated envelope;

a plurality of electrodes contained in said envelope, said electrodes including a pair of electrodes, each of said pair of electrodes provided with a triangular projection, said pair of electrodes arranged on the same plane in the side by side relationship; and means for alternately applying a field emission voltage to one of said pair of electrodes so as to have said one of said pair of electrodes function as an emitter and applying a voltage higher than the field emission voltage to the other of said pair of electrodes so as to have said other of said pair of electrodes function as a gate, to thereby establish an electric field capable of permitting alternate emission of field electrons between said pair of electrodes.

2. An electron emitting element as defined in claim 1, wherein said other of said pair of gate electrodes has alternately applied thereto a voltage which is positive with respect to the field emission voltage applied to said one of said pair of electrodes.

3. An electron emitting element as defined in claim 1, further including a collector electrode adjacent to said pair of electrodes.

4. An electron emitting element as defined in claim 3, wherein said pair of electrodes each is formed into an inverted trapezoid shape and said collector electrode is arranged to be positioned adjacent but not between said pair of electrodes and parallel thereto on a substrate.

5. An electron emitting element as defined in claim 4, wherein said pair of said electrode are arranged on said substrate through an insulating layer; and anodes are deposited on said substrate with phosphor layers arranged outside said electrodes, respectively.

6. An electron emitting element as defined in claim 5, wherein sine waves of which phases are deviated in 180° from each other or rectangular waves are applied to said pair of electrodes, respectively, and a voltage which is positive with respect to said pair of electrodes is applied to each of said anodes.

7. An electron emitting element as defined in claim 1, wherein said pair of electrodes are arranged in an interdigitated manner.

8. An electron emitting element as defined in claim 7, wherein said pair of electrodes arranged in an interdigitated manner are provided on a first substrate; and a transparent electrode functioning as an anode is provided on a second substrate arranged opposite to said first substrate.

9. An electron emitting element as defined in claim 8, wherein said transparent electrode is formed into a strip-like shape, on which phosphors of red, green and blue luminous colors are deposited in order.

* * * * *